United States Patent [19]

Carter

[11] Patent Number: 4,535,211

[45] Date of Patent: Aug. 13, 1985

[54] INDUCTOR AND METHOD OF MAKING SAME

[75] Inventor: Michael J. Carter, Troy, Mich.

[73] Assignee: Tocco, Inc., Boaz, Ala.

[21] Appl. No.: 664,414

[22] Filed: Oct. 24, 1984

[51] Int. Cl.[3] ..... H05B 6/42

[52] U.S. Cl. ..... 219/10.49 R; 219/10.41; 219/10.57; 219/10.79; 336/62; 29/602 R; 29/609

[58] Field of Search ..... 219/10.49 R, 10.79, 219/10.51, 10.41, 10.43, 9.5, 8.5, 10.57; 336/57, 58, 60, 62, 233, 234; 29/602 R, 606, 607, 609

[56] References Cited

U.S. PATENT DOCUMENTS

| | | | |
|---|---|---|---|
| 3,242,299 | 3/1966 | Laughlin et al. | 219/8.5 |
| 3,248,512 | 4/1966 | Sommer | 219/8.5 |
| 3,649,797 | 3/1972 | Vickers | 219/10.79 |
| 3,659,069 | 4/1972 | Balzer et al. | 219/10.79 |
| 3,737,613 | 6/1973 | Gillock | 219/10.79 |
| 3,800,115 | 3/1974 | Cachat | 219/10.43 |
| 3,842,234 | 10/1974 | Seyfried | 219/10.79 |
| 4,401,486 | 8/1983 | Pusateri et al. | 219/10.43 X |
| 4,430,543 | 2/1984 | Olofsson | 219/10.79 |

*Primary Examiner*—Philip H. Leung
*Attorney, Agent, or Firm*—Body, Vickers & Daniels

[57] ABSTRACT

A single loop inductor for inductively heating elongated work pieces is machined including cooling passages for a single piece of electrically conductive material without fabricated joints between the conductor sections.

14 Claims, 8 Drawing Figures

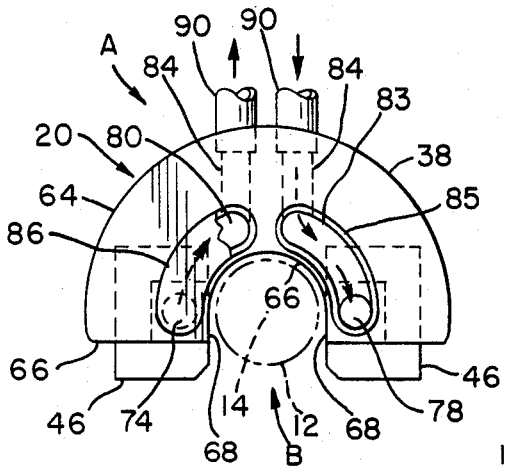
FIG. 3
FIG. 4
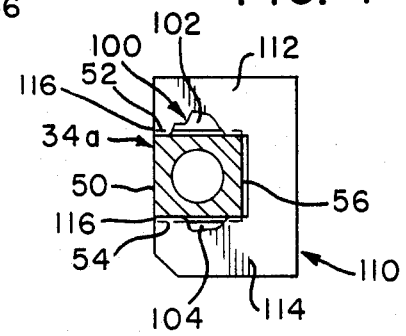
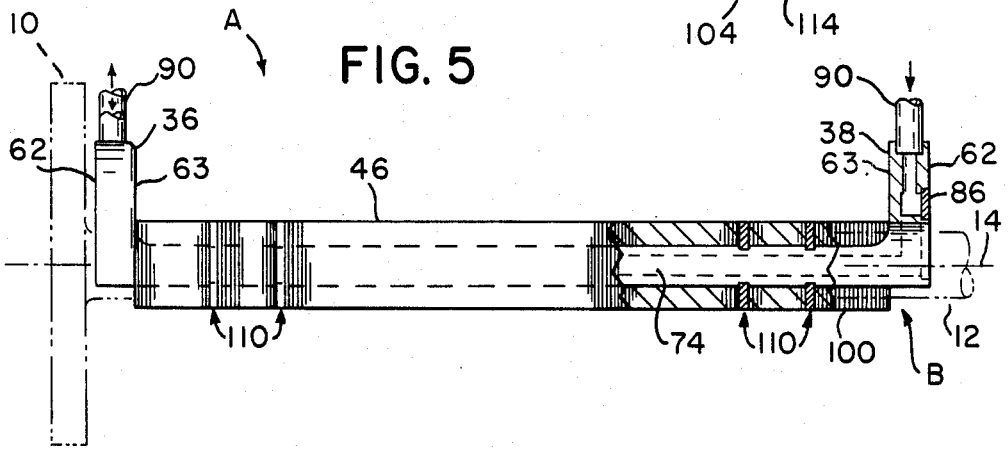
FIG. 5
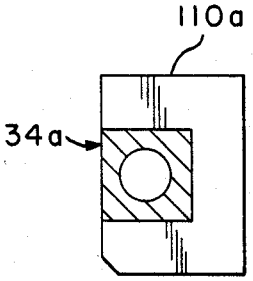
FIG. 6
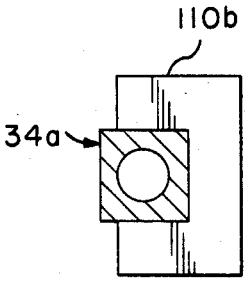
FIG. 7
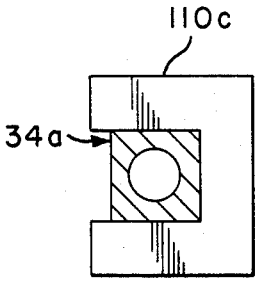
FIG. 8

INDUCTOR AND METHOD OF MAKING SAME

The present invention relates to the art of induction heating and, in particular, to single loop inductors for inductively heating elongated workpieces.

The invention is particularly applicable for heating the complete length of an axle shaft and will be described with particular reference thereto; however, it should be appreciated that the invention has much broader applications and may be used for heating various other elongated workpieces of constant or varying cross sections.

Induction heating followed by controlled quenching has become an accepted technique for surface hardening extended lengths of axle shafts. Therein, the axle shaft is rotated within the flux field of a stationary, single loop inductor. The single loop inductor is effective to uniformly, inductively heat the total length of the axial shaft without requiring movement of the inductor. This single loop inductor, commonly referred to as a "single shot inductor", comprises a pair of parallel conductors which extend substantially the complete length of the axle shaft. The ends of the parallel conductors are interconnected by arcuate crossover conductors. One of the conductors, either a parallel conductor or a cross-over conductor, is divided to define an electrical discontinuity. Electrical leads are connected at the discontinuity and therefrom to a high frequency power supply. In operation, the flux field from the parallel conductors induces eddy current heating at the surface of the rotating shaft to raise the temperature thereof above the critical temperature for the shaft material. The depth and temperature are determined by conventional control of the electrical parameters. After the shaft surface has reached the predetermined heating temperature, quenching jets rapidly cool the shaft at a controlled rate to provide the desired material properties over the length of the axle shaft.

Because of the high power levels carried by these inductors, copper materials are most widely used. Further, because of the heating load imposed by the work environment during the heating operation and to a lesser extent the electrical heating of the conductors during energization, it is necessary to provide the inductor with internal cooling to maintain the inductor at controlled operating temperatures. Heretofore, square copper tubing has been used as the material for fabrication of such inductors. These inductors have been fabricated using preformed lengths of the copper tubing which are joined to adjacent sections at mitered welded, brazed or soldered joints. Thus, each crossover connector is connected to the ends of the parallel conductors at mitered joints and the electrical leads are connected to a conductor at the discontinuity. Generally, a minimum of six such joints are required for a single loop inductor. Even with stringent manufacturing techniques, a fabricated coil is difficult to manufacture to close tolerances. Accordingly, the effective length of the parallel conductors varies from inductor to inductor. This in turn varies the length and causes variations in the heat treating cycle from inductor to inductor.

Moreover, the fabricated joints present resistance variations over the length of the inductor loop, particularly at the joints where the dissimilar materials present a localized increased resistance which can result in excessive heat build up in the vicinity of the joint. Additionally, the application and removal of high power levels at the start and conclusion of the heat cycles causes high reaction loads at the joints. Because of the stress concentration presented by this type of joint and the work hardening characteristics of the copper material, it has been found that most mechanical failures in the inductor occur through work hardening and resultant fracturing at the joint or in the vicinity thereof. Accordingly, notwithstanding proven performance of the copper tubing single-loop inductor design, there is a need for providing more accurate dimensional control in the inductor, eliminating the causes of mechanical failure while retaining the overall advantages of effective simultaneous heating of elongated workpieces that this type of inductor coil provides.

In accordance with the present invention, there is provided an improvement in single loop inductors wherein the inductor is fully machined from a single piece of copper in a manner which retains the advantages above mentioned while increasing the accuracy with which the inductor may be formed and extending the useful life thereof. More particularly, the parallel conductors and the crossover conductors are machined by conventional machining techniques from a single block of copper. This permits accurate control over the physical dimensions of the individual inductors and permits the highly loaded areas thereof to be increased in size and provided with stress reducing transition sections which eliminate the hot spots and stress concentration areas occuring at the fabricated joints. This also allows the manufacture of inductors to close tolerances and insures that uniform heating patterns will be provided in applications wherein plural apparatus are producing a common part. The parallel legs of the inductor are machined to a square cross section and have drilled holes extending axially therethrough. A round hole provides for increased cross section for the same external profile in comparison with inductors fabricated from square copper tubing. The end faces of the crossover conductor are provided with milled slots which communicate with the ends of the drilled holes. Cover plates are fixed over the milled slots and thereby define coolant passages throughout the length of the loop. At appropriate points along the electrical loop, drilled cross holes are provided to the passages. Coolant fittings carried therein are connected with coolant supply and drain lines to provide coolant loops for maintaining the operating temperature of the inductor at the optimum levels.

Accordingly, an object of the present invention is to provide a method of making an inductor coil from a single piece of electrically conductive material for improved strength and electrical characteristics.

Another object of the present invention is to provide a single loop inductor which eliminates joints between conductor sections for reducing localized stress at the start and conclusion of the heating cycle.

A further object of the present invention is to provide a single loop inductor having drilled coolant passages through the parallel conductors which provide increased electrical cross sections for increasing the power carrying capacity.

Still another object of the present invention is to provide an inductor for an induction heating apparatus having integrally formed parallel and crossover conductors with machined coolant passages configured for improved electrical conductivity and mechanical strength with reduced heat build up at the transitions between the parallel and crossover conductors.

A still further object of the present invention is to provide a single loop inductor coil for an induction heating apparatus that can be fully machined by conventional techniques to close tolerances and within reduced manufacturing times.

BRIEF SUMMARY OF THE DRAWINGS

The above and other objects and advantages will become apparent from the following description taken in conjunction with the accompanying drawings, in which:

FIG. 3 is an end view taken along line 3—3 of FIG. 2 showing the coolant passages in the crossover conductors and the operative connections to the coolant supply:

FIG. 4 is an enlarged cross sectional view taken along line 4—4 of FIG. 2 showing the coolant passage in the parallel conductor and the mounting of the flux concentrator keeper thereon;

FIG. 5 is a partially-sectioned side-elevational view of the inductor;

FIG. 6 is an enlarged cross sectional view taken along line 6—6 of FIG. 2 showing the mounting of one embodiment of the flux concentrator keeper on the parallel conductor;

FIG. 7 is a view similar to FIG. 6 showing another embodiment of the flux concentrator keeper; and, FIG. 8 is a view similar to FIG. 6 showing a further embodiment of the flux concentrator keeper.

DETAILED DESCRIPTION OF THE PREFERRED EMBODIMENT

Figure 2:
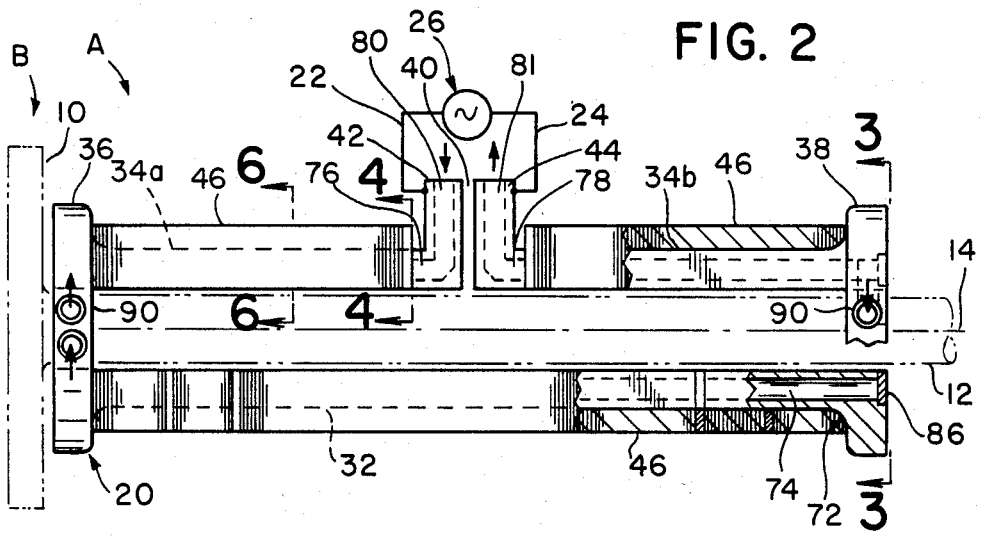
FIG. 2 is a plan view of the inductor of FIG. 1 showing the flux concentrators and schemmatically illustrating the electrical connection to a power supply, and showing in dashed lines an axle shaft to be inductively heated by the inductor.

Referring now to the drawings wherein the showings are for the purpose of illustrating a preferred embodiment of the invention only and not for the purpose of limitng same, FIG. 2 shows an induction heating apparatus A for inductively heating an elongated work piece B, such as an axle shaft, having a circular flange 10 and a cylindrical shaft 12. The work piece B is mounted for rotation about a horizontal axis 14 on a conventional induction heating unit, not shown. A predetermined length of the shaft 12 is heated to an elevated temperature by the induction heating apparatus A under conditions producing a uniform heating pattern to a predetermined depth. The heated shaft is then quenched by conventional quenching apparatus, not shown, under controlled conditions to produce a uniform hardness and hardened depth over the predetermined length of the shaft 12.

The heating apparatus A comprises a single-loop, or as commonly known a single-shot, inductor 20 connected by leads 22 and 24 to a conventional high frequency power supply 26. As hereinafter described, the inductor 20 includes internal coolant passages which are fluidly connected to a coolant supply, not shown.

Figure 1:
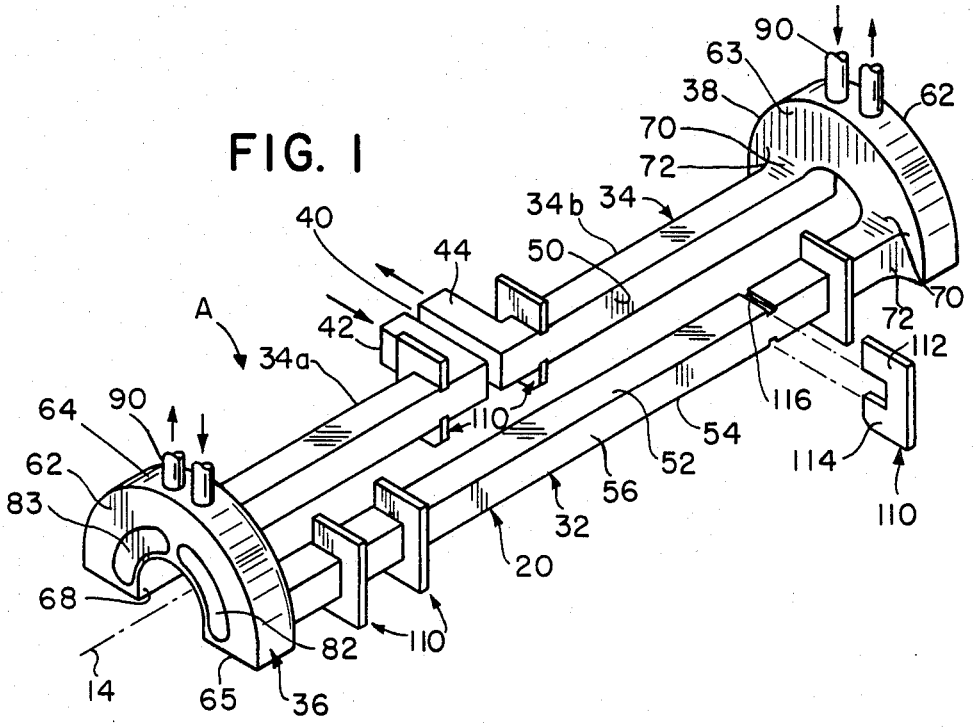
FIG. 1 is a perspective view of a single loop inductor made in accordance with the preferred embodiment of the present invention.

Referring to FIG. 1, the inductor 20 generally comprises a pair of longitudinally extending parallel conductors 32 and 34 integrally connected at their outer ends to a pair of transversely extending arcuate crossover conductors 36 and 38. The parallel conductor 34 is longitudinally divided into two equal sections 34*a* and 34*b* at an electrical discontinuity or gap 40. The inner ends of the sections 34*a* and 34*b* terminate with radially outwardly projecting axially spaced power leads 42 and 44. The power leads 42 and 44 are respectively electrically connected in a conventional manner to the leads 22 and 24, respectively, of the power supply 26. Flux concentrators 46 are carried on the parallel conductors 32 and 34 of the inductor 20 as hereinafter described in greater detail. In assembly, the inductor 20 is fixedly mounted coaxially with the work piece B about the axis 14 by a conventional holding fixture, not shown.

In accordance with the present invention, the inductor 20 hereinabove generally described, is fully machined from a single block of copper. With the exception of variations hereinafter noted, the inductor 20 is formed without mechanical or fabricated joints by conventional milling, drilling and turning operations. The inductor is particularly adapted for complete machining by computer assisted machinery centers.

The conductors 32 and 34, as shown in FIGS. 2 through 4, have square transverse cross sections and extend parallel to the axis 14. The conductors 32 and 34 are equally spaced with respect to the axis 14 and disposed in a common horizontal plane. The longitudinal length of the conductors as measured from the inner faces of the crossover connectors 36 and 38 is equal to the predetermined length over which the shaft 12 is to be uniformly hardened. Each of the conductors 34 and 36 has a vertical inner surface 50 which is radially spaced from the axis 14 to establish the requisite air gap with the outer surface of the shaft 12 thereby providing the required magnetic coupling during the inductive heating cycle. The conductors 34 and 36 have horizontal top and bottom surfaces 52 and 54, respectively. which are symmetrically disposed above and below the axis 14. Together with a vertical rear surface 56, the surfaces 50, 52 and 54 define a square transverse cross section. However, it will be apparent that rectangular or curvilear cross sections are also readily accomodated by the present invention.

The crossover conductors 36 and 38 have an outer face 62 lying in planes transverse to the axis 14 and coaxially spaced from the inner face 63. The width between the faces 63 and 62 is substantially the same or greater than the width of the parallel conductors 32 and 34 as measured between the surfaces 50 and 56. The crossover conductors 36, 38 have an outer circular cylindrical surface 64, coaxial with the axis 14, having a diameter substantially greater than the width between the rear surfaces 56 of the parallel conductors 32 and 34. The crossover conductors have a horizontal lower surface 65 lying in a plane coextensive with the lower surface 54 of the parallel conductors 32 and 34. The crossover conductors have an inner hemi-cylindrical surface 66 coaxial with the axis 14 having a diameter substantially the same as the width between the inner surfaces 50 of the conductors 32 and 34. The surface 66 downwardly terminates with vertically extending surfaces 68 coextensive with the lower half of the inner surfaces 50 of the parallel conductors 32 and 34. Horizontal fillets 70 of a substantial radius are provided at the transition between the top surfaces 52 of the parallel conductors 32 and 34 and the inner faces 60 of the crossover conductors 36 and 38. Vertical fillets 72 of substantial radius are provided at the transition between the outer surfaces 56 of the parallel conductors 32 and 34 and the inner faces 60 of the crossover conductors 36 and 38. The fillets 70 and 72 reduce the stress concentration at the sectional transitions during operation of the inductor.

The inductor 20 is provided with a plurality of coolant passages which extend throughout the effective electrical length of the single loop. A single longitudinal passage 74 is drilled axially through parallel conductor 32 and the adjoining sections of crossover conductors 36 and 38. A pair of passages 76 and 78 are drilled axially through the crossover conductor 36 and the parallel conductor section 34*a*, and the crossover conductor 38 and the parallel conductor section 34*b*, respectively. The tips of the drilled passages 76 and 78 terminate just short of the inner surfaces of the leads 42 and 44 defining the gap 40. A pair of radial passages 80 and 81 are drilled centrally through the leads 42 and 44, respectively, and intersect with and fluidly communicate with the associated drilled passages 76 and 78. The diameter of the aforementioned drilled passages, together with the exterior dimensions of the parallel conductors, establishes a current flow path having sufficient capacity to handle the power load applied to the inductor during the inductive heating cycle. The circular drilled hole provides for greater cross section and power capacity than square tubing of comparable dimensions.

Referring to FIG. 3, a pair of arcuate milled slots 82 and 83 are formed in the end faces 62 of the crossover conductors 36 and 38. Each slot, 82 and 83, spans a sector of approximately 80° and has a lower end registering with the end of the drilled passages 74, 76 and 78 and an upper end which is spaced from the end of the adjacent slot. A pair of counterbored passages 84 are formed vertically in the crossover conductors 36 and 38 and fluidly communicate with the upper ends of each slot. A recessed rim 85 is formed adjacent the sidewall of the slots. An arcuate cover plate 86, corresponding in dimension to the rim, is received therein and brazed or soldered to the end faces 62 to seal the slots. Coolant pipes 90 are received in the couterbores of each vertical passage 84 and brazed or soldered therein. Similar coolant connections, not shown, are provided at the outer extremities of the power leads 42 and 44. When the coolant pipes are connected with the supply and drain lines of the coolant supply, the direction of coolant flow through the coolant passages will be in the direction indicated by arrows. In the illustrated preferred embodiment, 3 separate coolant circuits are provided. A first coolant circuit extends through the passage 74 and slot 82. A second coolant circuit extends through the passage in conductor section 34*a*, the passage in power lead 42 and the slot 83 in the crossover conductor 36. A third cooling circuit extends through the passage in conductor section 34*b*, the passage in the associated power lead 44 and the slot 83 in the crossover conductor 38. The objective of the cooling branches is to provide high pressure, high flow rate cooling circuits throughout the operative length of the parallel conductors having sufficient heat removal capacity to keep the associated conductor at a controlled operating temperature. Should redundant circuits be desirable or required, it is apparent that parallel circuits can be provided within each of the cooling branches. Further, should only a single cooling circuit be desired, it is apparent that the inlet and the outlets can be in the power leads and a single hemispherical milled slot could be provided in the end faces 62 of the crossover conductors to interconnect the passages and the associated parallel conductors.

The flux concentrators 46 carried by the parallel conductors 32 and 34 provide, in a well known manner, control over the applied flux density in order to permit a single inductor to be used for heating, to a predetermined depth, work pieces having varying heat treated lengths or diameters. They are also effective for providing uniformity of the flux density on a work piece having an axially varying cylindrical section. In order to be fully effective, it is necessary to locate the flux concentrator elements along the axial or longitudinal length of the parallel conductors in a position accurately corresponding to the desired heating pattern. Moreover, at the incremental axial positions, it is necessary to have appropriately located elements for achieving the desired heating depth thereat on parts having profile variations.

As shown in FIGS. 4–8, the flux concentrators 46 are comprised of a plurality of U-shaped elements 100. The individual elements, in a well known manner, may be soft iron laminations or other high magnetic permeability laminates. Each element is formed with a pair of spaced legs 102,104 which are slidably received over the top and bottom surfaces 52 and 54 of the associated parallel conductor sections. The effective length of the legs 102, 104 may be varied with respect to the parallel conductor to selectively vary the applied flux density therefrom. The flux concentrator elements are held in discrete banks of laminations by generally U-shaped keepers 110. The keepers 110 have top and bottom and rear surfaces corresponding to the shape of the flux concentrator. The width of the legs 112, 114 of the keeper members is slightly wider than the opening between the legs of the associated concentrator elements. Key ways 116 are milled transversely across the top and bottom surfaces of the parallel conductor sections. The key ways 116 are accurately referenced from the machined surfaces of the inductor to define between facing surfaces of the individual keepers or the end faces of the crossover conductors, an accurately, axially located spacing for receiving a predetermined number of flux concentrator elements. In this manner, the effective length of the lamination stack-up can be precisely controlled from inductor to inductor giving greater consistency and control over the hardness pattern produced from one coil to the next. To provide for greater versatility in a single inductor design, various keyways may be formed along the effective length of the inductor sections which can be selectively utilized to prescribe heating profiles for varying part configurations. While the keeper arrangement is obviously beneficially incorporated in the fully machined inductor coil described above, it is apparent that the accurate locating of the concentrator laminates can be achieved by providing comparable keeper arrangements on fabricated conductors or in other inductive heating applications using flux concentrator members for varying and controlling the flux density of the coil. As shown in FIGS. 6 through 8, the keepers 110 and the concentrator elements 100 may have legs of differing length and shape for providing discrete changes in the heating pattern for differing part profiles and hardness requirements while maintaining the inductor configuration.

Further, with regard to the fully machined inductor, it will be apparent that other orientations of the parallel conductors and the cross sectional variations therein can be incorporated for affirmatively prescribing the heating patterns to be generated. Thus, for instance, the parallel conductors may lie in planes intersecting the rotational axis and may have longitudinally varying cross sections for controlling the heating pattern, either in combination with the flux concentrators or independent thereof. Moreover, the power leads may be in the form of separate sections which are mechanically joined or bonded to the inner ends of the conductor sections to form a discontinuity for the power inputs. This modification, however, retains the benefits provided by the fully machined construction and introduces the fabricated joints at areas where the effect of cyclic stressing have not proven to be unacceptable.

I claim:

1. A single loop inductor suitable for inductively heating a generally cylindrical elongated part comprising:

a one piece member, adapted to be positioned coaxial with the part, having a pair of arcuate axially spaced crossover conductors lying in a plane transverse to the axis and integrally interconnected with a pair of linear conductors extending parallel to the axis and mutually radially spaced therefrom;

a first set of drilled passages formed longitudinally in each said linear conductors, said passages having ends extending through said crossover conductors;

slot means formed in the end faces of said cross-over conductors and communicating said ends of said passages;

means establishing an electrical discontinuity in one of said conductors;

lead means electrically connected to said one of said conductors on opposite sides of said electrical discontinuity;

means for sealing said slot means in said end faces of said crossover conductors whereby said slot means and said first set of drilled passages define internal coolant passages in said conductors;

a second set of drilled passages formed at spaced locations of the conductors fluidly communicating with said coolant passages and having exteriorally opening ends adapted to be connected to a coolant supply during said heating for establishing a coolant circuit for cooling said conductors.

2. The inductor as recited in claim 1, wherein said second set of drilled passages includes passages communicating with said coolant passages at said opposite sides of said electrical discontinuity.

3. The inductor as recited in claim 2, wherein said slot means in one of said end faces comprises a pair of slots each having one end communicating with one of the passages of said first set and the other end communicating with said second set of drilled passages and interconnected with said passages at said electrical discontinuity to define plural coolant circuits for said inductor.

4. The inductor as recited in claim 3, wherein said crossover conductors have a cross sectional area substantially greater than the cross sectional area of said linear conductors.

5. The inductor as recited in claim 4, wherein said crossover conductors have an inner cylindrical surface substantially coextensive with the inwardly facing surfaces of said linear conductors and an outer cylindrical surface extending substantially radially outward of the outwardly facing surfaces of said linear inductors.

6. The inductor as recited in claim 2, wherein said electrical discontinuity is in one of the linear conductors.

7. The inductor as recited in claim 1, wherein said slot means comprise a pair of mutually spaced arcuate slots in the end faces of each crossover conductor.

8. The inductor as recited in claim 7, wherein said second set of drilled passages comprises drilled passages formed adjacent the interior end of each slot and extending to adjacent the lead means to define plural cooling circuits for said inductor.

9. The inductor as recited in claim 1 wherein transition sections of substantial curvature are provided between said crossover conductors and said linear conductors.

10. The inductor as recited in claim 1, wherein said linear conductors have a substantially square cross section and said first set of drilled passages are centrally formed therein.

11. The inductor as recited in claim 1, wherein a first passage is drilled longitudinally through one of said linear conductors and both of said crossover conductors, and a pair of passages are drilled through said crossover conductors and partially through the other of said linear conductors, said pair of passages having tip positions in spaced relation intermediate the length of said other of said linear conductors, and said electrical discontinuity is formed through said other of said linear conductors intermediate said tip portions.

12. A method of making a single loop inductor for inductively heating an elongated cylindrical workpiece comprising the steps of:

machining from a single piece of electrically conductive material a pair of elongated, parallel conductors at opposite ends interconnected by arcuate conductors;

drilling a first passage longitudinally through the arcuate conductor sections and entirely through one of the elongated conductors;

drilling a second passage through one of the arcuate conductor sections and partially through the other of the elongated conductors;

drilling a third passage through the other of the transverse conductor sections and partially through said other of the elongated conductors, said second passage and said third passage having tip portions in non-communicating spaced relationship intermediate the length thereof;

forming slot means in the arcuate conductors communicating with the drilled passages;

sealing said slot means whereby the drilled passages and the slot means define coolant circuit means substantially coextensive with said conductor sections;

severing said other of said elongated conductors transversely between the tip portions of said second passage and said third passage thereby establishing an electrically conductive path between the spaced portions of said other of said elongated conductors;

adapting said spaced portions for electrical connection to a power supply; and forming passage means in said conductor sections fluidly communicating with said coolant circuit means at spaced locations thereof adapted for fluid connection to a coolant supply for delivering coolant throughout the length of said coolant circuit means.

13. The method recited in claim 12, wherein said slot means include a pair of mutually spaced arcuate slots formed in the outer end faces of the arcuate conductors, each of the slots fluidly communicating at one end with the one of the drilled passages and at another end with passage means formed radially through the arcuate conductor whereby the slot and associated drilled passage define separate cooling branches for the fluid circuit means.

14. A method of making an inductor for inductively heating cylindrical workpieces comprising the steps of:

forming from a single piece of electrically conductive material, first and second elongated conductor sections interconnected at opposite ends by transverse conductor sections;

forming a drilled passage means longitudinally through the transverse conductor sections and entirely through at least one of the elongated conductor sections;

forming recesses in the transverse conductor sections communicating with the drilled passage means;

sealing said recesses whereby the drilled passages and recesses define an internal passage means substantially coextensive with said conductor sections;

severing one of the conductor sections to establish an electrical discontinuity;

forming connecting passage means in said conductor sections fluidly communicating with said internal passage means.

* * * * *